United States Patent [19]

Wells et al.

[11] 3,942,936

[45] *Mar. 9, 1976

[54] FACING RING AND POURING CHUTE FOR VERTICALLY CAST CONCRETE PIPE

[75] Inventors: Frank M. Wells, Aztec, N. Mex.; Gordon J. Black, Nuevo, Calif.

[73] Assignee: Ameron, Inc., Monterey Park, Calif.

[ * ] Notice: The portion of the term of this patent subsequent to July 24, 1991, has been disclaimed.

[22] Filed: Nov. 21, 1974

[21] Appl. No.: 525,820

Related U.S. Application Data

[63] Continuation of Ser. No. 385,189, Aug. 2, 1973, Pat. No. 3,856,453.

[52] U.S. Cl. ..... 425/447; 249/100

[51] Int. Cl.[2] ..... B28B 21/04

[58] Field of Search ..... 425/253–255, 425/262, 447; 249/100, 105, 107–108; 222/481–482; 141/102, 234, 288, 302

[56] References Cited

UNITED STATES PATENTS

| | | | |
|---|---|---|---|
| 1,014,444 | 1/1912 | Broussard | 141/234 |
| 1,298,647 | 4/1919 | Bewley | 425/447 |
| 1,453,269 | 5/1923 | Buente | 425/447 |
| 1,503,358 | 7/1924 | Evans | 249/100 |
| 1,810,583 | 6/1931 | Tuerck | 425/468 |
| 2,858,594 | 11/1958 | Eirich et al. | 425/447 |
| 3,239,591 | 3/1966 | Wendt | 425/447 |
| 3,300,098 | 1/1967 | Quester et al. | 141/302 |
| 3,856,453 | 12/1974 | Wells et al. | 425/468 |

*Primary Examiner*—Robert D. Baldwin
*Assistant Examiner*—John McQuade
*Attorney, Agent, or Firm*—Christie, Parker & Hale

[57] ABSTRACT

A pipe mold for vertically cast concrete pipe includes a cylindrical outer mold case, a cylindrical core spaced inside the mold case, and a pipe-reinforcing cylinder between the core and the case. A system for casting concrete in the pipe mold includes a flat facing ring above the annular space between the mold case and the cylinder. A chute assembly mounted concentrically above the pipe mold includes several radially extending and spaced apart pouring chutes extending downwardly from the center of the chute assembly to corresponding circumferentially spaced apart openings in the facing ring. The pouring chutes channel the flow of concrete into the openings in the facing ring to fill the pipe mold to the bottom surface of the facing ring, which forms a flat annular end section at the desired elevation on the pipe. The facing ring eliminates the need for hand finishing and measuring which is common in the prior art manufacture of vertically cast concrete pipe. A concrete pipe with a beveled end section is formed by mounting the facing ring in an angular plane above the pipe mold. As the concrete is channeled into the openings of the beveled facing ring, gates in the pouring chutes are sequentially closed to progressively block the rise of concrete from the low side to the high side of the facing ring until the pipe mold is filled to the bottom of the ring which automatically forms a flat, beveled annular end section at the desired elevation on the pipe.

17 Claims, 8 Drawing Figures

FACING RING AND POURING CHUTE FOR VERTICALLY CAST CONCRETE PIPE

CROSS REFERENCE TO RELATED APPLICATIONS

This is a continuing application of application Ser. No. 385,189, filed Aug. 2, 1973, now U.S. Pat. No. 3,856,453.

BACKGROUND OF THE INVENTION

This invention relates to the art of casting concrete pipe, and more particularly to a novel apparatus for pouring concrete into a vertically oriented pipe mold.

In the manufacture of certain types of large-diameter concrete pipe, for instance pipe having a diameter as wide as 20 feet, concrete is poured into a vertically disposed pipe mold comprising a cylindrical outer mold case and a cylindrical inner core. In most instances, the pipe is reinforced with a relatively thin-walled cylindrical steel shell, or cylinder, which is disposed in the pipe mold between the outer mold case and the inner core and becomes embedded in the pipe wall when concrete is cast in the pipe mold. The top of the cylinder generally is provided with a spigot-type end ring. When the concrete is poured into the annular space between the mold case and the cylinder, the top level of the concrete is "foreshortened" to form a flat annular end section which is spaced below the spigot ring so that during use, the spigot ring of the pipe can be joined with a cooperating bell-type end ring of an adjoining concrete pipe section.

In some instances, concrete pipe is cast as a straight pipe section in which the spigot ring and the foreshortened annular end section of the pipe lie in separate horizontal planes. In other instances, concrete pipe is cast as a beveled pipe section in which the spigot ring and the foreshortened annular end section lie in planes which are inclined relative to the axis of the pipe.

In the conventional method of casting concrete pipe, a "tamping top" is mounted on top of the pipe mold. The tamping top includes a "spigot round-up ring" engaged with the spigot ring to hold the top of the reinforcing cylinder in a fixed position, and a ring-shaped "halo bar" engaged with the top of the outer mold case to hold the case in a fixed position and maintain equal spacing between the reinforcing cylinder and the mold case. The tamping top forms a continuous annular opening between the cylinder and the mold case through which concrete is to be poured. Once the tamping top is in place, an inverted conical-shaped "pouring cone" is placed above the center portion of the tamping top. Concrete is then emptied from a bucket onto the top of the pouring cone which distributes the concrete evenly through the annular opening in the tamping top. The pouring cone also evenly distributes concrete to the annular space between the cylinder and the inner core. The space between the outer mold case and the cylinder generally is overfilled above its desired elevation, and after the pouring cone is removed, excess concrete at the top of the mold is then dug out by hand, measured with a depth gauge, and hand-troweled to provide a flat, properly leveled annular end section for the pipe.

The job of hand-finishing the foreshortened annular end section of the pipe is a time-consuming and costly process, particularly because of the large size of the pipe, and because the finished end section of the pipe must meet relatively narrow tolerances. Beveled pipe in particular is laborious and costly to finish. The pipe form for beveled pipe generally is overfilled to form a horizontal annular end section, and the excess concrete on the low side of the bevel is then dug out and finished to the desired bevel by offset measurements which require substantial time and effort by the workmen.

SUMMARY OF THE INVENTION

This invention provides a system for vertically casting concrete pipe in such a way that the time-consuming and laborious prior art job of hand-finishing the annular end section of the pipe is substantially eliminated.

Briefly, the system includes a pipe mold having an outer mold case and an inner cylinder spaced concentrically inside the outer mold case. A flat facing ring is mounted above the annular space of the pipe mold, and a downwardly extending pouring chute is mounted concentrically above the pipe mold. The pouring chute is in communication with an opening in the facing ring. The pouring chute channels the flow of concrete into the opening in the facing ring, and the concrete is distributed in the annular space of the pipe mold until the mold is filled. When the concrete is filled to the bottom of the facing ring, the facing ring forms a flat, automatically leveled annular end section for the pipe which eliminates the need for the hand-finishing and measuring which are common in the prior art.

The facing ring may be mounted in a substantially horizontal plane to form the end section of a straight pipe, or it may be mounted in a plane which is inclined relative to the horizontal to form a beveled end section for the pipe.

In a preferred form of the invention, several radially extending and circumferentially spaced apart pouring chutes are aligned with corresponding circumferentially spaced apart openings in the facing ring. In instances where a beveled pipe section is produced, concrete is channeled into the openings of the facing ring by the pouring chutes until the concrete level reaches the low side of the facing ring. Thereafter, as pouring continues, gates in the pouring chutes are sequentially closed to progressively block the rise of concrete from the low side to the high side of the facing ring until the concrete is filled to the bottom of the facing ring, which will automatically provide a planar, beveled annular end section for the pipe.

These and other aspects of the invention will be more fully understood by referring to the following detailed description and the accompanying drawings.

DETAILED DESCRIPTION OF THE PREFERRED EMBODIMENTS

Figure 1:
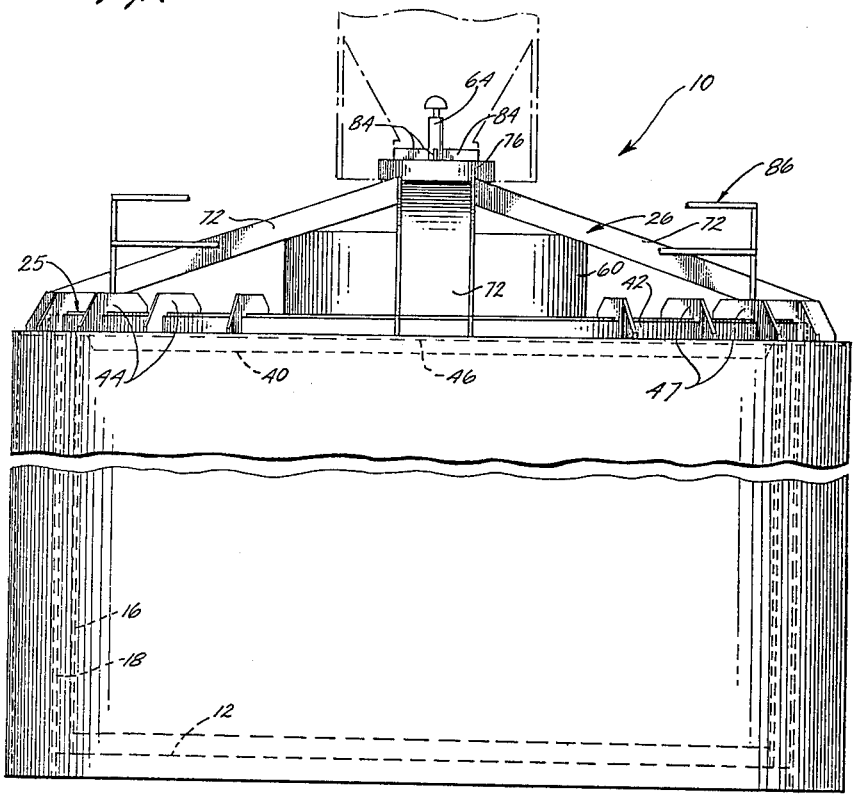
FIG. 1 is a fragmentary elevation view showing a facing ring and pouring chute assembly in accordance with this invention mounted on a vertically disposed pipe mold for use in casting concrete in the pipe mold.

Referring to FIG. 1, a system for casting a concrete pipe section includes a vertically disposed pipe mold assembly 10 mounted over a base ring 12 on the ground to provide means for holding the bottom of the pipe mold components in a fixed position relative to each other. The pipe mold comprises a cylindrical steel outer mold case 14 and a cylindrical steel core 16 placed concentrically inside the outer mold case. A relatively thin-walled steel shell or cylinder 18 is disposed in the pipe mold between the outer mold case and the core. During use of the pipe mold, concrete is poured into the outer annular space between the mold case and the cylinder and into the inner annular space between the cylinder and the core to form a concrete pipe section. Thus, cylinder 18 becomes embedded in the concrete to provide reinforcing for the pipe section.

The concrete pipe section has a bell-type end at its bottom and a spigot-type end at its top. As shown best in FIG. 3, the spigot end of the pipe includes a rigid metal spigot ring 20 at the top of cylinder 18. A concrete inner lining 22 of the pipe is poured to the top of the spigot ring, and a concrete outer layer 24 of the pipe is poured to a foreshortened position relative to the top of inner lining 22. In a belled end of the pipe the bottom of the concrete inner lining 22 is foreshortened relative to the bottom of concrete outer layer 24.

The concrete is poured into pipe mold 10 with the aid of a top ring 25 mounted on the top edge of inner core 16, and a pouring chute assembly 26 mounted over the center portion of the top ring. The detailed construction of the top ring will be understood best by referring to FIGS. 2 through 5. Top ring 25 includes a pair of flat semi-circular plate halves 28 mounted in a diametrically opposed relation on a rigid supporting framework so the plate halves form the equivalent of a circular plate which covers the circular opening above the center of mold case 10. The supporting framework for the top ring includes a plurality of radially outwardly extending support members 30, each of which includes a pair of opposed C-shaped channel bars 32 rigidly secured together to form the equivalent of an I-beam. Plate halves 28 are welded to the top of the I-beams. Circumferentially spaced apart openings 34 in the plate halves are covered with wire mesh to provide vent holes for the central portion of the top ring.

An inner round-up ring 36 is rigidly secured to the outer edges of I-beams 30 and plate halves 28. The outer edge of the inner round-up ring is notched to form an annular shoulder 38 adapted to rest on the annular top edge of core 16 to hold the top ring in place on top of the pipe mold. A guide ring 40 below the inner roung-up ring extends diagonally downwardly and inwardly toward the center of the top ring. The bottom of the guide ring is rigidly secured to the bottom outer edge of the I-beams to hold the guide in a fixed position for use in guiding the top ring into position above the pipe mold.

An outer round-up ring 42 is held in a fixed position spaced outwardly from and concentric relative to inner round-up ring 36. The inner and outer round-up rings form an annular opening 43 in the top ring above the annular mold cavity between core 16 and cylinder 18. During use of the top ring, concrete is poured through annular opening 43. A plurality of circumferentially spaced apart bridge bars 44 are rigidly secured to the tops of I-beams 30 and to the tops of the inner and outer round-up rings to hold the two rings in a fixed, equidistantly spaced apart relation. When the top ring is mounted on the pipe mold, the inner face of outer round-up ring 42 abuts against the outer face of spigot ring 20. Thus, the inner and outer round-up rings maintain the top portions of core 16 and cylinder 18 in a fixed equidistantly spaced apart relation which maintains a true annular open space between the cylinder and the core.

An outwardly extending flat facing ring 46 is rigidly secured to the bottoms of outer round-up ring 42 and bridge bars 44 to hold the facing ring at a fixed elevation below the top edges of core 16 and spigot ring 20. The outer edge of facing ring 46 engages the inner edge of mold case 14 to hold the top of the mold case in a fixed spaced-apart position relative to the top ring, thereby maintaining a fixed continuous width for the annular mold cavity between mold case 14 and cylinder 18. The bottom of the facing ring forms the top of the foreshortened annular end section 47 of the outer layer 24 of the cast concrete pipe section.

Figure 2:
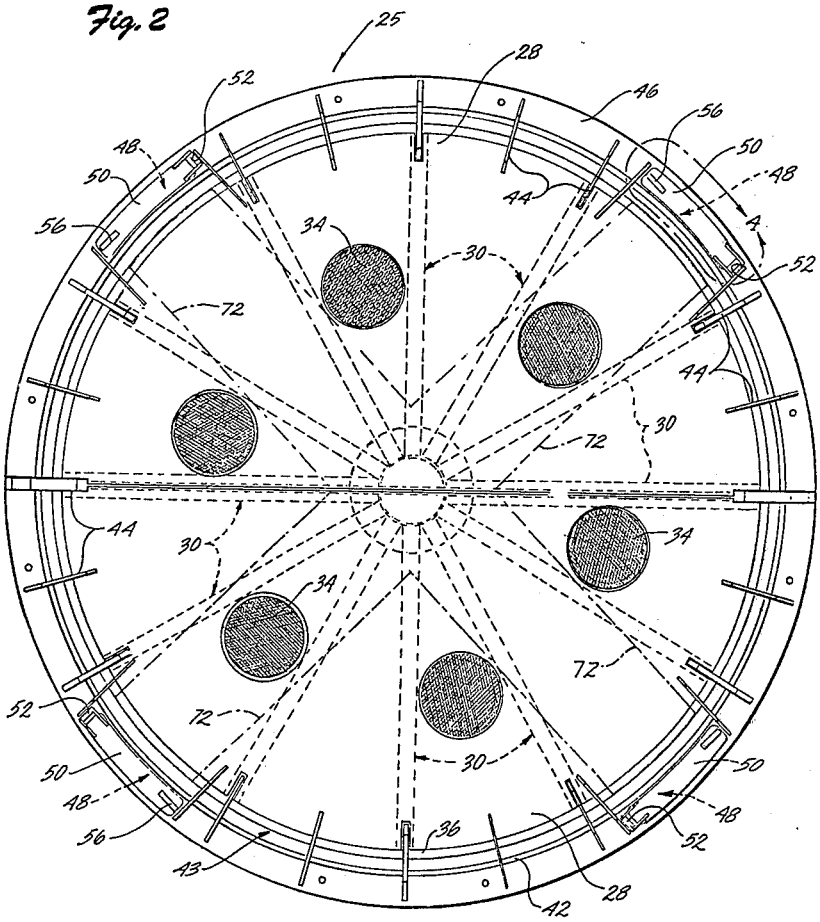
FIG. 2 is a plan view showing the detailed construction of the facing ring.
Figure 4:
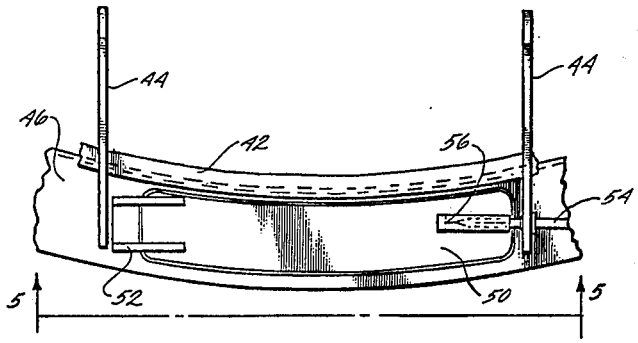
FIG. 4 is an enlarged fragmentary plan view showing a facing ring door assembly taken within the circle 4 of FIG. 2.
Figure 5:
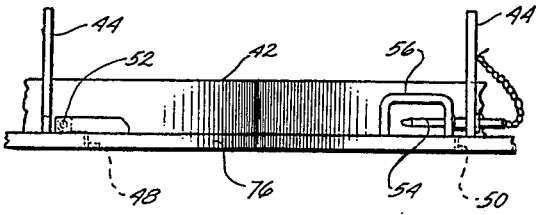
FIG. 5 is a fragmentary elevation view taken on line 5—5 of FIG. 4.

As shown best in FIGS. 2, 4 and 5, several circumferentially spaced apart openings 48 are formed in facing ring 46, preferably at equidistantly spaced apart locations around the ring. As shown best in FIG. 2, the openings occupy a small portion of the facing ring area. Each opening 48 is covered by a respective door 50 having a hinge 52 at one end thereof to allow the door to be either opened, by pivoting it upwardly from the top of the facing ring, or closed by lying flush against the top of the facing ring over opening 48. The opposite end of each door includes a separate locking pin 54 which engages a corresponding opening in a handle 56 to form a releasable lock for the door. The underside of each door is shaped to lie in the same plane as the bottom of facing ring 46 so the bottom of the facing ring will provide a continuous flat engaging surface for use in forming a flat top surface for end section 47 of the pipe.

Figure 6:
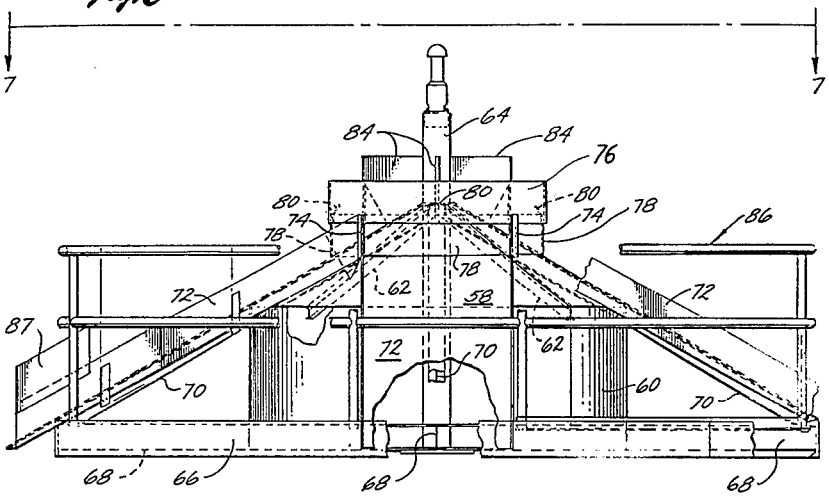
FIG. 6 is a fragmentary elevation view, partly in cross-section and partly broken away, showing the detailed construction of the pouring chute assembly shown in FIG. 1.
Figure 7:
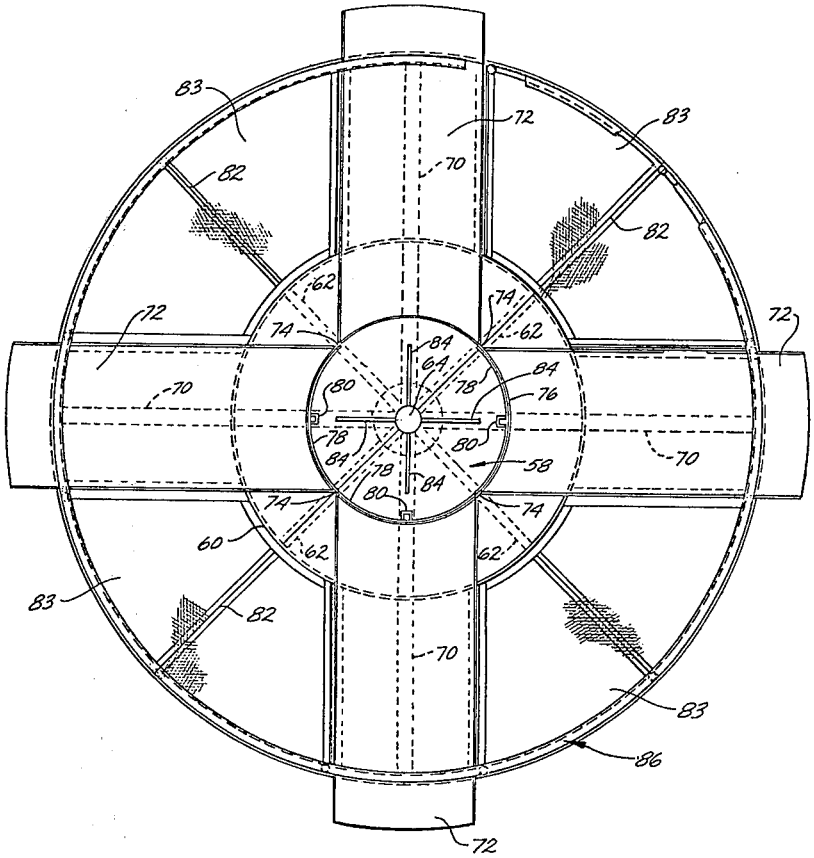
FIG. 7 is a plan view taken on line 7—7 of FIG. 6.

Pouring chute assembly 26 is understood best by referring to FIGS. 1, 6 and 7. The central area of the pouring chute assembly includes an inverted conical shaped metal pouring cone 58 supported on an upright annular frame 60, the top edge of which is rigidly secured to the bottom annular edge of the pouring cone. A plurality of radially outwardly and downwardly extending I-beams 62 are welded to the underside of pouring cone 58 to provide rigid support for the pouring cone base. The outer ends of I-beams 62 are rigidly secured to the top inner upright edge of annular frame 60.

Pouring cone 58 is centered around an upright rigid arm 64 extending along the vertical axis of the pouring chute assembly. The inner edges of I-beams 62 are rigidly secured to the outer edge of arm 64.

An outer base ring 66 forms the bottom of the pouring chute assembly. The base ring is rigidly braced by radially spaced apart, horizontally extending I-beams 68. The bottom of annular frame 60 is rigidly secured to the tops of I-beams 68 to center pouring cone 58 above base ring 66. The pouring cone is further interconnected with the base ring by radially outwardly and downwardly extending I-beams 70, the top edges of which are rigidly secured to the underside of the pouring cone. The inner edges of I-beams 70 are secured to the outer edge of arm 64, and the outer edges of I-beams 70 are rigidly secured to the inner vertical edge of base ring 66 to provide a rigid supporting framework for the pouring chute assembly.

As shown best in FIG. 7, I-beams 70 are spaced 90° apart, and each I-beam provides support for the bottom of a corresponding one of four radially outwardly and downwardly extending, upwardly opening, U-shaped pouring chutes 72. Each pouring chute 72 extends radially outwardly beyond the outer extent of base ring 66. The side walls of each pouring chute terminate at their top ends adjacent a plurality of radially spaced apart and vertically extending support bars 74. A horizontally disposed, relatively thin-walled ring 76 made of flat sheet metal is secured to the tops of support bars 74 to be held above the tops of the pouring chutes in a position centered with respect to arm 64. A separate arcuate slotted opening is formed between the base of each pouring chute and the bottom of ring 76. Three of these openings are closed off by separate arcuately curved, vertically slidable, elongated gate members 78 (shown in FIGS. 7 and 8, but not in FIG. 1 for clarity). The top portion of each gate member abuts against the inner edge of ring 76. Each gate member has a corresponding upwardly and inwardly extending handle 80 which can be used to pull the gate member upwardly to open the space between the base of the pouring chute and the bottom of ring 76.

The pouring chute assembly also includes four radially extending and equidistantly spaced apart, horizontally disposed composite I-beams 82 extending outwardly from the bottom of arm 64 to the outer base ring 66. I-beams 77 provide support for separate screen sections 83 which cover the spaces between the pouring chutes. Four equidistantly spaced apart, vertically disposed support members 84 are secured at their inner edges to the outer edge of arm 64. Support members 84 extend radially outwardly therefrom in an equidistantly spaced apart relation. The pouring chute assembly also includes an upright hand rail 86 which spans the outer edge of the pouring chute assembly to provide means for allowing workmen to steer the pouring chute assembly into place when it is mounted above top ring 25.

Figure 3:
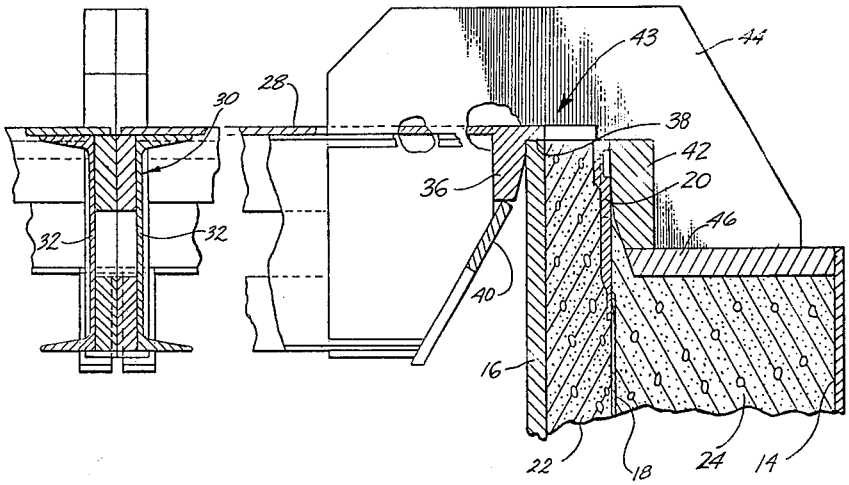
FIG. 3 is a fragmentary cross-sectional elevation view showing the facing ring mounted on top of the pipe mold.

During use of the top ring and pouring chute assembly, a crane (not shown) hoists the top ring above the pipe mold and places the top ring on top of core 16 in the position shown best in FIGS. 1 and 3. Outer mold case 14 is hoisted up and then lowered into position around the top ring so the top inner edge of the outer mold case engages the outer edge of facing ring 46. The crane then hoists pouring chute assembly 26 above the top ring, and workmen position the assembly so that the four pouring chutes 72 are aligned with the four door openings 48 of facing ring 46, as illustrated best in phantom line in FIG. 2. (Depending upon the size of the pipe to be cast, three, two, and even one pouring chute and facing ring door opening may be used.) When the pouring chute assembly is in place above the top ring, base ring 66 of the pouring chute assembly rests on top of the central circular plate of the top ring. As shown best in FIG. 2, when the pouring chute assembly is in its proper position, the extreme outer edges of pouring chutes 72 rest on top of inner round-up ring 36 and extend to the outer vertical edge of the inner round-up ring. Concrete is then ready to be poured into the pipe mold from a bucket 78 (illustrated in phantom line in FIG. 1) which is hoisted above the pouring chute assembly by the crane. The bucket is lowered over arm 64 which engages a releasable gate assembly in the bottom of the bucket in a manner well known in the art to pour the concrete on pouring cone 58. This allows the concrete to be channeled through the open gates of the pouring chutes and into the pipe mold. A major portion of the concrete poured on the chute assembly will be channeled to the inner mold cavity between core 16 and cylinder 18. Preferably, the pipe mold is filled by alternately pouring concrete into the inner mold cavity and then the outer mold cavity (between case 14 and cylinder 18), but always keeping the inner mold cavity filled to a higher level than the outer mold cavity to prevent collapsing cylinder 18. When the outer mold cavity is to be filled, suitable hinged extension means 87 (only one of which is shown in FIG. 6 for clarity) at the end of each pouring channel are rotated into place to extend the length of the pouring chutes so that the concrete can be poured directly into the outer mold cavity only through the door openings in facing ring 46. This method of pouring the concrete into the pipe mold is continued until the inner and outer mold cavities are filled. The outer mold cavity is poured to the bottom of facing ring 46, and doors 50 are then closed. The facing ring forms a continuous, flat, foreshortened, annular end section at the proper elevation on the pipe. This eliminates the prior art steps of removing substantial excess material from the end section of the pipe, and also reduces the substantial amount of hand-finishing common in the prior art. The facing ring also has the advantage of establishing the exact elevation of the pipe end section without the requirement of constantly gauging the level of the end section as it is being hand troweled.

Figure 8:
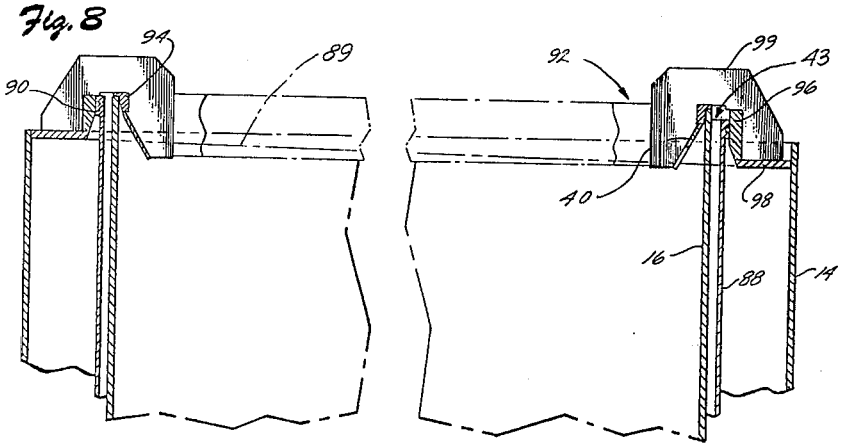
FIG. 8 is a fragmentary cross-sectional elevation view showing the facing ring assembly of this invention mounted on a pipe mold for forming a beveled pipe section.

FIG. 8 illustrates a system for casting a pipe having a beveled annular end section (represented in phantom line at 89). In FIG. 8 the bevel angle of the pipe end section is exaggerated for clarity. When casting beveled pipe end sections, the same pouring chute assembly as that described in FIGS. 1 through 7 can be used. although the top ring is modified slightly. In this instance the pipe mold includes outer mold case 14 and inner core 16. A reinforcing ring 88 with a beveled spigot ring 90 (the ring 90 is "beveled", meaning it is in an inclined plane having the same angle as the beveled annular end section to be formed at the end of the pipe) is disposed in the pipe mold between the core and the case. A beveled top ring assembly 92 includes an inner round-up ring 94 identical to ring 36. The inner round-up ring 94 is mounted on the top edge of core 16 and therefore is in a horizontal plane. An outer round-up ring 96 which engages the outer circumference of beveled spigot ring 90 supports a beveled facing ring 98 which defines the top surface of the beveled end section of the pipe. The bottoms of outer round-up ring 96 and bridge bars 99 hold facing ring 98 in an inclined plane defining the desired bevel angle for the pipe.

In use, pouring chute assembly 26 is placed on top of beveled top ring 92, and the concrete is poured into the pipe mold in a manner identical to that described above. When the top level of the concrete reaches the low side of facing ring 98, the gate for the distribution channel going to the low side of the facing ring is closed to block the further rise of concrete through its corresponding door opening. As the concrete continues to rise and start to come through the adjacent door openings, the other two remaining gates are closed, as are their corresponding doors, and the concrete is poured again until it starts to come through the remaining door opening on the high side of facing ring 98. The last door is closed, and top ring 92 is eventually removed to provide a beveled end section which is planar continuously around the pipe and in which the bevel is formed at the desired elevation without requiring the hand finishing, troweling, and measuring procedures common in the prior art.

We claim:

1. In a vertically disposed pipe mold having a cylindrical outer mold case, and an inner cylinder disposed concentrically inside the outer mold case to form an annular mold cavity between the outer mold case and the inner cylinder into which concrete is to be poured, apparatus for casting a concrete pipe in the pipe mold comprising a facing ring for encircling the cylinder and for being mounted above the annular mold cavity, the facing ring including a plurality of spaced apart gate means, and means for individually opening and closing the gate means to control the passage of concrete through the facing ring into the mold cavity below it; and a pouring chute assembly for being mounted in a fixed position above the facing ring, the pouring chute assembly including a base for being positioned above the facing ring and for providing a region onto which concrete is to be poured, and a plurality of radially extending and elongated pouring chutes for extending downwardly from the base to corresponding gate means in the facing ring so that concrete poured onto the base of the pouring chute assembly will be distributed by the individual pouring chutes through the gate means in the facing ring to the annular mold cavity, the facing ring providing an undersurface which will form a shaped annular end section of the cast pipe when concrete is filled to the bottom of the facing ring.

2. Apparatus according to claim 1 including closure means for selectively blocking the passage of concrete through certain of the pouring chutes to control the passage of concrete through corresponding gate means of the facing ring.

3. Apparatus according to claim 1 including means for holding the facing ring above the mold cavity at an angle inclined relative to true horizontal so that the facing ring will form an annular beveled end section for the cast concrete pipe, and including closure means for selectively blocking the passage of concrete through certain of the pouring chutes so that sequential closing of the closure means, once the level of the concrete poured through the respective gate means reaches the low side of the inclined facing ring, will progressively block the rise of concrete in the mold cavity from the low side to the high side of the facing ring so the facing ring will form a beveled end section on the pipe.

4. Apparatus according to claim 1 in which the pipe mold includes a cylindrical inner core disposed concentrically inside the cylinder to form an annular inner mold cavity into which concrete is to be poured; in which the facing ring is mounted only above the outer annular mold cavity between the outer mold case and the cylinder; in which the pouring chute assembly is mounted above both mold cavities; and including means for adjusting the position of each pouring chute relative to its respective gate means so that each pouring chute can be in communication with either the inner mold cavity or with its corresponding gate means of the facing ring.

5. Apparatus according to claim 4 in which the pouring chutes extend normally to a position above the inner mold cavity; and in which the pouring chute adjusting means comprises means for extending the length of the pouring chutes to circumvent the inner mold cavity and allow concrete to be poured directly through the gate means of the facing ring.

6. Apparatus according to claim 4 in which the facing ring includes a support for being disposed concentrically inside the inner core and on which the pouring chute assembly is mounted to hold it in its fixed position above the facing ring; and a plurality of circumferentially spaced apart bridge members extending from the support to the facing ring, the bridge members supporting the facing ring above the outer annular mold cavity.

7. Apparatus according to claim 5 including means for holding the facing ring above the mold cavity at an angle inclined relative to true horizontal so that the facing ring will form an annular beveled end section for the cast concrete pipe, and including closure means for selectively blocking the passage of concrete through certain of the pouring chutes so that sequential closing of the closure means, once the level of concrete poured through the gate means reaches the low side of the inclined facing ring, will progressively block the rise of concrete in the mold cavity from the low side to the high side of the facing ring so the facing ring will form a beveled end section on the pipe.

8. Apparatus according to claim 6 including means for holding the facing ring above the mold cavity at an angle inclined relative to true horizontal so that the facing ring will form an annular beveled end section for the cast concrete pipe, and including closure means for selectively blocking the passage of concrete through certain of the pouring chutes so that sequential closing of the closure means, once the level of concrete poured through the gate means reaches the low side of the inclined facing ring, will progressively block the rise of concrete in the mold cavity from the low side to the high side of the facing ring so the facing ring will form a beveled end section on the pipe.

9. Apparatus for casting concrete pipe comprising:

a. a cylindrical outer mold case;

b. a cylinder disposed concentrically inside the outer mold case to form between the outer mold case and the cylinder an annular mold cavity into which concrete is to be poured;

c. means for smoothing the annular top end of the cast pipe including a facing ring encircling the outer circumference of the cylinder and mounted above the annular mold cavity, the facing ring including a plurality of spaced apart openings for the passage of concrete through the facing ring into the mold cavity below it, the openings in the facing ring together occupying a minor portion of the facing ring area;

d. a pouring chute assembly mounted in a fixed position above the facing ring, the pouring chute assembly including pouring base disposed above the facing ring for providing a region onto which concrete can be poured, and a plurality of elongated pouring chutes extending downwardly from the pouring base to corresponding openings in the facing ring so that concrete poured onto the base of the pouring chute assembly will be distributed by the individual pouring chutes through the openings in the facing ring to the annular mold cavity; and e. means for controlling the passage of concrete from the pouring chutes through the openings in the facing ring, the facing ring having an undersurface which forms a shaped annular end section of the cast pipe when concrete in the mold cavity is filled to the bottom of the facing ring.

10. Apparatus according to claim 9 in which the means for smoothing the end of the pipe includes a support inside the cylinder for holding the pouring chute assembly in its fixed position above the facing ring, and a plurality of circumferentially spaced apart bridge bars extending from the support to the facing ring, the bridge bars supporting the facing ring above the mold cavity.

11. Apparatus according to claim 9 in which the pipe mold includes a cylindrical inner core disposed concentrically inside the cylinder to form between the core and the cylinder an annular inner mold cavity into which concrete is to be poured; in which an outer mold cavity is formed between the cylinder and the outer mold case, and the facing ring is mounted only above the outer annular mold cavity; and in which the pouring chute assembly is mounted above both mold cavities; and including means for adjusting the position of each pouring chute relative to its respective opening in the facing ring so that each pouring chute can be in communication with the inner mold cavity or with its respective opening in the facing ring.

12. Apparatus according to claim 11 in which the pouring chutes extend normally to a position above the inner mold cavity; and in which the pouring chute adjusting means comprise means for extending the length of the pouring chutes to circumvent the inner mold cavity and allow concrete to be poured directly through the openings in the facing ring.

13. Apparatus according to claim 11 in which the means for smoothing the end of the cast pipe includes:

a. a support disposed concentrically inside the inner core for holding the pouring chute assembly in its fixed position above the facing ring;

b. a round-up ring mounted on the inner core for maintaining the support in a fixed position inside the inner core; and c. a plurality of circumferentially spaced apart bridge members extending from the support to the facing ring, the bridge members supporting the facing ring above the outer annular mold cavity.

14. Apparatus according to claim 13 including means for holding the facing ring above the mold cavity at an angle inclined relative to true horizontal so that the facing ring will form an annular beveled end section for the cast concrete pipe; and in which the means for controlling passage of the concrete includes closure means for selectively blocking the passage of concrete through certain of the pouring chutes so that sequential closing of the closure means, once the level of concrete poured through the openings in the facing ring reaches the low side of the facing ring, will progressively block the rise of concrete in the mold cavity from the low side to the high side of the facing ring so the facing ring will form a beveled annular end section of the pipe.

15. Apparatus according to claim 14 in which the facing ring includes means for individually opening and closing the openings therein.

16. Apparatus according to claim 9 including means for holding the facing ring above the mold cavity at an angle inclined relative to true horizontal so that the facing ring will form an annular beveled end section for the cast concrete pipe; and in which the means for controlling passage of the concrete includes closure means for selectively blocking the passage of concrete through certain of the pouring chutes so that sequential closing of the closure means, once the level of concrete poured through the openings in the facing ring reaches the low side of the facing ring, will progressively block the rise of concrete in the mold cavity from the low side to the high side of the facing ring so the facing ring will form a beveled end section of the pipe.

17. Apparatus according to claim 16 in which the facing ring includes means for individually opening and closing the openings therein.

* * * * *

UNITED STATES PATENT AND TRADEMARK OFFICE

CERTIFICATE OF CORRECTION

PATENT NO. : 3,942,936

DATED : March 9, 1976

INVENTOR(S) : FRANK M. WELLS ET AL

It is certified that error appears in the above-identified patent and that said Letters Patent are hereby corrected as shown below:

Col. 3, line 63, "roung-up" should read -- round-up --.

Col. 8, line 63, "including pouring" should read
(Claim 9-d.) -- including a pouring --.

Signed and Sealed this

*first* Day of *June 1976*

[SEAL]

*Attest:*

RUTH C. MASON
*Attesting Officer*

C. MARSHALL DANN
*Commissioner of Patents and Trademarks*